United States Patent [19]

Arena

[11] 4,293,021

[45] Oct. 6, 1981

[54] SUPPORT FOR TRAVERSING WINDOW COVERING DEVICE

[76] Inventor: Joseph P. Arena, 254-43 Pembroke Ave., Great Neck, N.Y. 11020

[21] Appl. No.: 45,938

[22] Filed: Jun. 6, 1979

[51] Int. Cl.[3] ..... E06B 9/38

[52] U.S. Cl. ..... 160/178 R; 160/166 A; 160/173; 160/176 R

[58] Field of Search ..... 160/166–178

[56] References Cited

U.S. PATENT DOCUMENTS

| | | | |
|---|---|---|---|
| 3,054,446 | 9/1962 | Cayton | 160/173 |
| 3,500,896 | 3/1970 | Endou | 160/173 |
| 4,122,884 | 10/1978 | Salzmann | 160/178 R |

*Primary Examiner*—Kenneth Downey
*Attorney, Agent, or Firm*—Kenyon & Kenyon

[57] ABSTRACT

A support member for horizontal members or elements in a traversable opening covering device is disclosed. In the preferred embodiment, the opening covering device is a vertical blind for a window opening. The vertical blind includes a plurality of vanes and carriers supporting the vanes, and a track structure for traversably supporting the carriers. The rod controls movement of the vanes, i.e. traversing or rotating of the vanes. In the preferred embodiment, the carriers are traversed by a cord arrangement and the support member also supports the cord. The support member comprises a body having an opening therein adapted to slidably receive the horizontally extending rod, shoulders or rollers disposed on opposed sides of the body adapted to be traversably received in the track structure, and another opening or a spring arrangement associated with the body adapted to receive a cord therein which is used to traverse the carriers and which is releasably and frictionally engaged with the opening or spring arrangement. Movement of the cord traverses the carriers and also traverses the support member from one end of the track structure to a predetermined supporting location at the central part of track structure. The support member is retained at the predetermined location at the central part of the track structure when the frictional engagement between the cord and support body is overcome so that further movement of the cord traverses the carriers but not the support member.

18 Claims, 8 Drawing Figures

10
16
18
22
24
26A
28
32
34
36
38
42
44
46
48
64
66
68
70
72
74
75
76
78
90
92
93
94
96
96A
98
100
102
104
106
108
110
120
122
126
128
129
130
132

SUPPORT FOR TRAVERSING WINDOW COVERING DEVICE

BACKGROUND OF THE INVENTION

The present invention relates generally to traversing opening covering devices and more particularly to a traversable support for one or more horizontally-extending members or elements in such devices.

Traversing window or opening covering devices as used herein include vertical blinds, traversable draperies and similar traversable window and wall covering devices and traversable space separating devices. Common to such devices is one or more horizontally-extending members or elements. In vertical blind structures, the horizontally-extending member or element may be one or more rods used to effect traversing and/or rotation, or a cord or similar element used to effect traversing. For a traversable drapery, the horizontally-extending member may be the support rod and/or a cord or similar element used to effect traversing. The traversable support according to the invention prevents sagging of such horizontally-extending members or elements. The invention and its background will be further described in connection with vertical blinds, it being understood, however, that the invention and its use are not limited to vertical blinds.

Vanes of vertical blinds are usually supported by and suspended from members commonly referred to as carriers which themselves are traversably supported by a track structure. The carriers include means interconnecting them to limit the distance by which they may be separated; such means commonly comprise spacers or spacer links. The carriers also include means for mounting drive means for rotating the vanes and at least one of the carriers in the blind includes means by which the carrier may be moved along the track or traversed.

In one type of vertical blind structure, gearing is disposed in the carrier which, upon being driven, causes the vane suspended from the carrier to rotate. The gearing is driven by a horizontally-extending rotation rod. This type of blind structure is described in my U.S. Pat. No. 4,140,169 issued on Feb. 20, 1979, which is incorporated herein by reference. In this type of blind structure, the rotation rod is rotatably supported at its ends in the track structure with the rotation rod extending through the carriers. Since the rotation rod extends through the carriers, the carriers also support the rotation rod when the carriers and vanes are extended or traversed and distributed along the length of the track. However, when the carriers and vanes are retracted and stacked or bunched to one side of the track structure, the rotation rod is unsupported except adjacent the ends thereof. Thus, the rotation rod tends to sag near the center of the rod and the sag may become excessive as the length of the blind structure increases. Similarly, the cord used to traverse the blind vanes will also tend to sag. The sagging of the rotation rod and cord become visible and detract from the appearance of the blind structure.

In addition, such sagging affects mechanical operation of the blinds. For example, a sagging rod has "free play" where the rod is unrestrained, i.e. unsupported by carriers; rotation of the rod to effect rotation of the vanes pivots the rod in the unsupported region thereby whipping the unrestrained rod against adjacent walls of the track structure. This can damage the rods and the track structure, and becomes noisy, thereby detracting from the blind's performance.

In the type of blind structure described in my aforementioned U.S. Pat. No. 4,140,169, a cord arrangement is utilized to effect traverse of the carriers and vanes and only a single rod extends horizontally in the track structure which, as mentioned, is used for rotating the vanes.

In another type of vertical blind structure, two rods extend horizontally in the track structure. One rod is used to rotate the vanes and the other rod is used to traverse the carriers and vanes. This other type of blind structure is described in U.S. Pat. No. 3,190,346 issued to Joseph P. Arena et al. on June 22, 1965, which is incorporated herein by reference. Both rods will tend to sag in this other type of blind structure when the carriers and vanes are retracted and stacked or bunched to one side. Either rod can be whipped against the other or against adjacent walls of the track structure during operation of the blind.

SUMMARY OF THE INVENTION

It is an object of the present invention to provide support for one or more horizontally-extending members or elements in a traversing opening covering device.

It is another object of the present invention to provide support for one or more horizontally-extending members in a vertical blind structure.

It is still another object of the present invention to prevent sagging of one or more horizontally-extending rods and/or a cord in a vertical blind structure.

This and other objects are achieved by providing in accordance with the present invention a traversable support for one or more horizontally-extending members or elements in a traversing opening covering device. The support is itself traversably supported by a horizontally extending support structure whereby the support can be moved to an otherwise unsupported region for supporting the one or more horizontally-extending members or elements.

In accordance with the preferred embodiment of the invention, such a support is provided for a horizontally-extending rod and/or a traversing cord in a vertical blind structure which includes a track structure, a plurality of traversable and rotatable vanes and respective carriers for supporting the vanes which are traversable in the track structure, and vane moving, i.e. traversing and rotating, means for moving the vanes. The moving means for moving the vanes include at least one horizontally-extending rod which is used in rotating or traversing the vanes, and/or a cord arrangement for traversing the vanes.

The support according to the invention comprises mounting means for traversably mounting (e.g. sliding or rolling) the support in or on the track structure, supporting means for traversably engaging and supporting the horizontally-extending rod, and support traversing means by which the support is engaged and traversed in or on the track structure between predetermined locations thereof. The support traversing means are releasably movably engaged with the traversing means of the vane moving means to traverse the support between the predetermined locations upon traversing of the vanes over a portion of the track structure. The support traversing means is releasable from moving engagement with the traversing means for the vanes whereupon the support remains substantially stationary in one of the predetermined locations in or on the track structure upon traversing of the carriers over remaining portions of the track structure.

According to the preferred embodiment, the support comprises a body member having at least one first hole therethrough which receives and engages the horizontally-extending rod, the rod being traversably supported in the first hole. The body extends between opposed tracks of the track structure and elongated shoulders extend from opposed sides of the body and are traversably engaged in the opposed tracks.

In the preferred embodiment, the support is provided for use in a vertical blind structure having a single horizontally-extending rod which is used to rotate the vanes and a cord arrangement for traversing the carriers and vanes. The means according to the preferred embodiment for traversing the support comprises friction means engaged by the cord used to traverse the carrier in the vertical blind structure. The support also supports the cord and in the preferred embodiment, the friction means acts to support the cord. The cord traverses the support in the track structure between the predetermined locations in response to movement of the cord. The means for traversing the support further comprises a projection which engages a fixed member of the track structure at one of the predetermined locations, the friction means being adapted to being released from engagement with the cord when the projection and fixed member are in contact, whereby the support remains at the one predetermined location upon further movement of the cord and corresponding traversing of the carriers. The friction means in one embodiment comprises a second hole in the support having a dimension less than that of the thickness of the cord so that the cord is frictionally engaged by the second hole and moves the support with it. In another embodiment, the friction means comprises a spring finger arrangement. The support moves with the cord until the friction between the cord and the friction means of the support is overcome when the projection contacts the fixed member, whereupon the cord slides past the friction means upon further movement of the cord.

These and other aspects of the invention will be more apparent from the following description of the preferred embodiment thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENT

Referring more particularly now to the drawings, the support member 10 and the vertical blinds 12 in which the support is disposed are illustrated.

Figure 1:
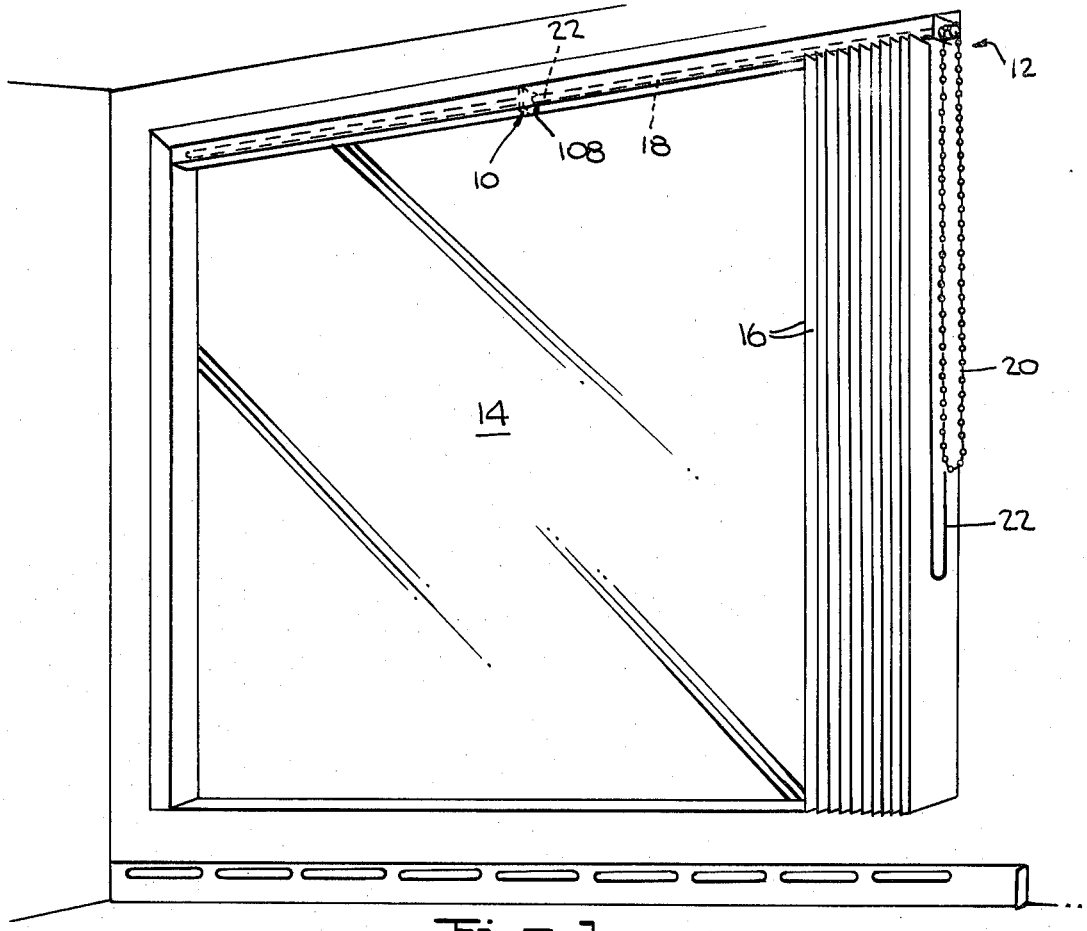
FIG. 1 is a perspective view depicting the support member disposed in a vertical blind structure in accordance with the preferred embodiment of the invention.

FIG. 1 depicts the vertical blinds 12 mounted along a window opening 14 with the vanes 16 traversed to a completely retracted position drawn to the right side, with the vanes in an open rotated position. The support member 10 is in a traversed position in the central part of the blinds supporting the rod 18 which is used to rotate the vanes and the cord 22 used to traverse the vanes. The chain 20 is used to actuate rotation of the vanes and the suspended portion of the cord 22 at the right side of the blind is used to traverse the vanes.

The carriers 24 (FIGS. 2–4) from which the vanes 16 are suspended comprise a body 26 and a spacer 28. Advantageously, the carrier 24 may be of the type described in my aforementioned U.S. Pat. No. 4,140,169. Spacer 28 extends from the carrier body and includes a tab 30 (FIGS. 2 and 3) at the distal end of the spacer. A slotted opening 32 (FIG. 4) is provided in the end of the carrier which is opposite the end from which the spacer extends, with the opening 32 and spacer 28 including the tab 30 being sized so that the spacer and slotted opening of adjacently mounted carriers may be interconnected for traversable movement along the track 34. The spacer is inserted in the slotted opening and slidable therein with the tab interlocking adjacent carriers by preventing the spacer of one carrier from being axially withdrawn from the opening of an adjacent carrier. Thus, the length of the spacers determines the maximum distance that the carriers may be spaced apart. Sections 36 form a slot at the top of the opening 32 and retain the spacer in the opening.

Figure 6:
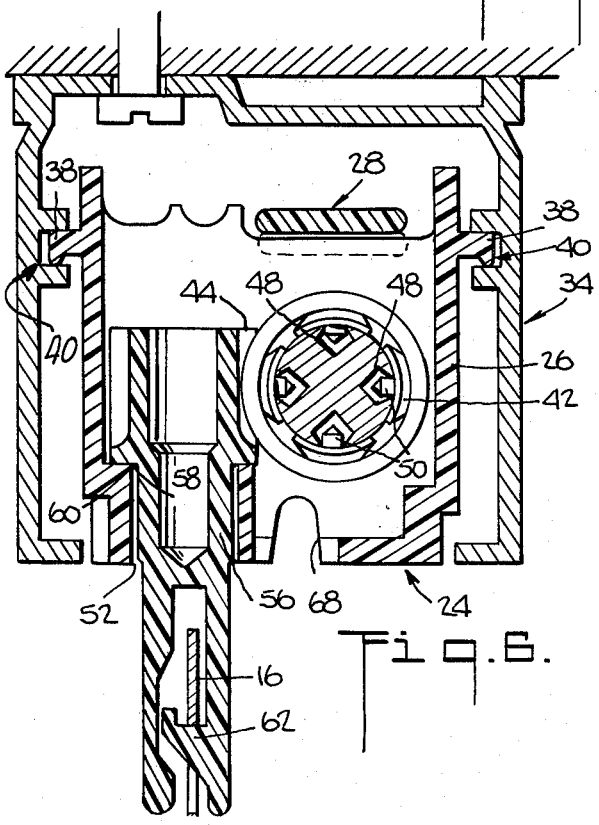
FIG. 6 is a vertical section taken along lines 6—6 of FIG. 3.
Figures 4, 7, 8:
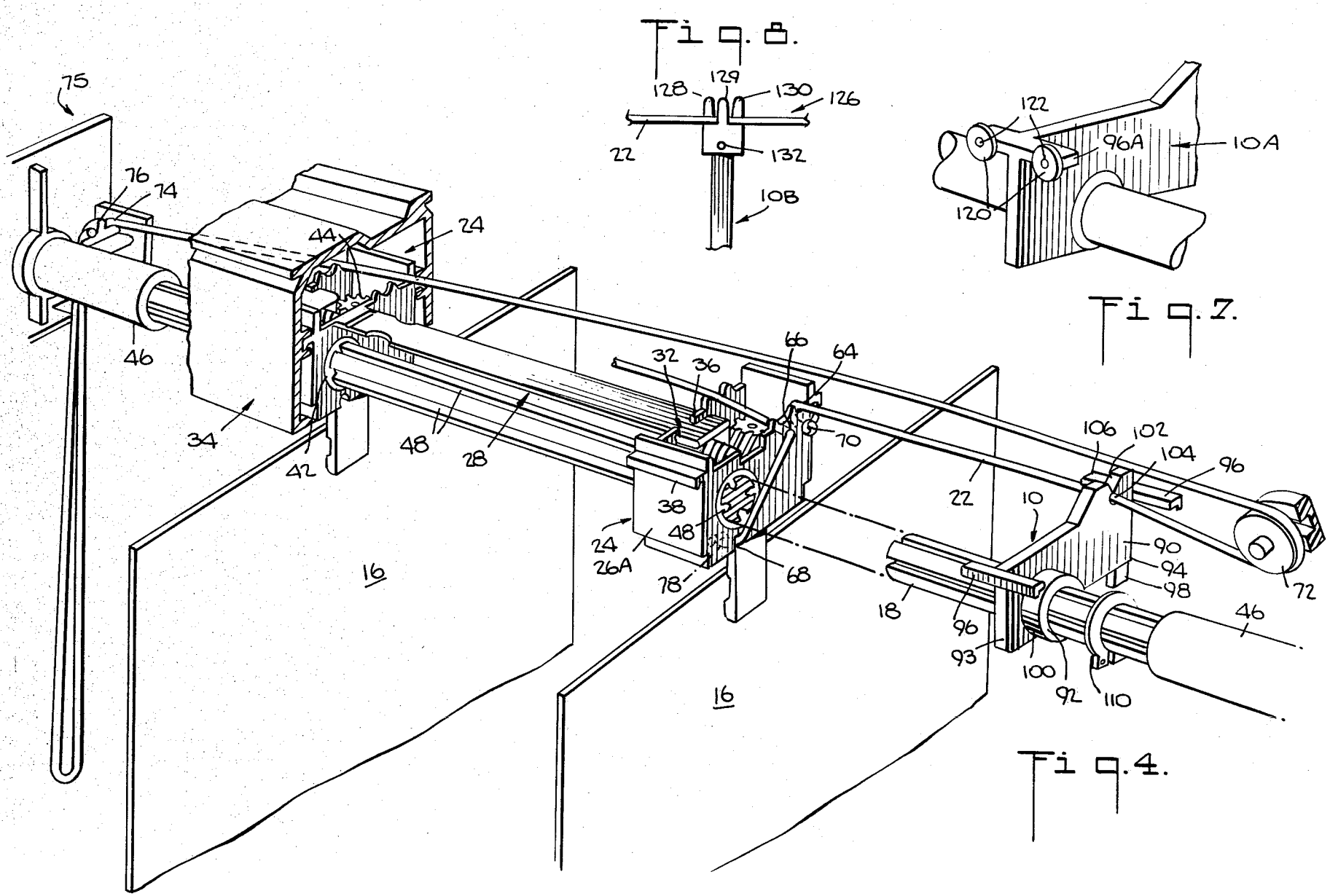
FIG. 4 is a perspective view partially in section of the side of the upper track structure opposed to that shown in FIGS. 2 and 3, and depicting the carriers and the support member on the rotation rod, and the cord arrangement for traversing the carriers and support member.
FIG. 7 is a perspective view of a portion of the support of FIGS. 2–4 illustrating another embodiment of mounting means therefor.
FIG. 8 is a side view of a portion of the support of FIGS. 2–4 illustrating another embodiment of friction means therefor.

As shown in the drawings, the carriers are mounted for a right-drawn blind. Referring to FIGS. 4 and 6, carrier 24 includes L-shaped shoulders 38 projecting outwardly from opposed sides of the carrier which support the carriers and suspended vanes 16 in the interior track raceways 40 (FIG. 6) longitudinally disposed along the interior of opposed sides of the track 34. The shoulders and raceways are sized so that the carrier may be mounted in and slidably supported by the raceways. It is also contemplated that wheels and an associated raceway may be used instead of the L-shaped shoulders.

As shown in FIGS. 4 and 6, the carrier body 26 houses a worm 42 and a worm wheel 44 for rotating the vanes. The rotation rod 18 is longitudinally disposed within track 34 and extends through opposed openings in the ends of carrier bodies 26. The rod is rotatably supported adjacent opposed ends of the track in sleeves 46 made of a low friction material such as Nylon. The sleeves 46 are rigidly secured in the ends of the track. The worms 42 are hollow and are disposed in the carrier bodies 26 with the rotation rod 18 extending through the worms. Female splines 48 extend axially along rotation rod 18 and ribs or male splines 50 (FIG. 6) extend axially along the inner circumference of worm 42. The splines are sized such that the male splines are slidably engaged within the female splines. Thus, the worm will rotate with the rotating rod and is in slidable engagement with respect thereto.

Figure 5:
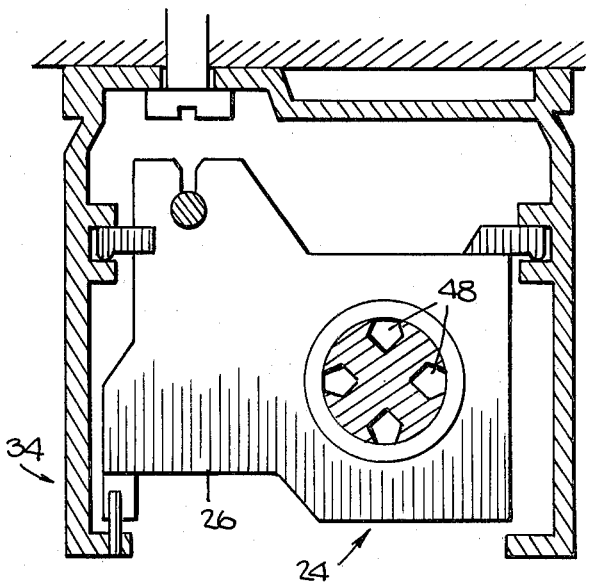
FIG. 5 is a vertical section taken along lines 5—5 of FIG. 2.

Also disposed in carrier bodies 26 for rotation therein are the worm wheels 44. As shown in FIG. 5, carrier bodies 26 have another opening 52. Secure . to worm wheel 44 is bushing 56 which is sized and disposed to rotate within opening 52. The bushing is of reduced diameter compared to the worm wheel and, as a result, the end of the worm wheel adjacent the bushing forms a shoulder 58 which is supported by shoulder 60 of the carrier body. Bushing 56 includes an axially slotted section having a hook 62 and vanes 16 include a slot (not shown) for securing the vanes to the bushings. The openings in the carrier bodies and the worms and worm wheels are sized and disposed so that the worms and worm wheels mesh, whereupon rotation of the worms cause the worm wheels and vanes to rotate.

FIG. 4 shows a lead carrier body 26A and a cord arrangement for traversing the carriers. The lead carrier body 26A is positioned as the extreme left carrier (the overall directions being reversed between FIGS. 2, 3 and FIG. 4) in a right-draw blind (and as the extreme left carrier in a left-draw blind with two lead carriers being used in a bi-parting blind). Carrier body 26A includes holes 64, 66 disposed in the left end (right end as shown in FIG. 4) of the carrier body and an opening 68 (FIG. 6) is disposed in the bottom of the carrier body adjacent opening 52. A cord 22 is attached to the carrier body by means of such holes as follows. A knot 70 is made in one end of cord 22 or a piece such as a ball or tab (not shown) is affixed or crimped to that cord end. The cord is pulled into the carrier body through opening 64 and out of the carrier body through the top thereof with the knot 70 engaging the one end of the cord in the end face of the carrier body. The cord is then passed through guide 66 in the top of the carrier body and through a hole in the support 18 and around pulley 72 disposed in the left (right in FIG. 4) end of the track 34. From pulley 72, the cord is run to the opposite end of the track and out through an opening 74 in end 75. A loop of cord is formed (FIGS. 1 and 4) outside of the track with the cord being returned to the inside of the track through opening 76 also in end 75. The other end 78 of the cord is then run back to the lead carrier body 26A. The end 78 is secured in carrier body 26A by passing it into the top of the carrier body, out through opening 66, along the left (right in FIG. 4) end of the carrier body and back into the carrier body through opening 68. A knot is tied to retain the cord end 78 in the carrier body. The opening 68 extends to the bottom of the carrier body and includes an enlargement into which the knot is inserted, the knob being prevented from being withdrawn through hole 68 since the knot is larger than the hole. As the carriers are traversed to the left from the positions shown in FIG. 2 to the positions shown in FIG. 3, the spacers slide through the slotted openings and over the oppositely disposed spacer of an adjacent carrier, the stacking of the spacers being facilitated by the flexing or hinging of the spacers upwardly about sections 22.

Referring to FIG. 4, the support member 10 includes a body 90 having an opening 92 sized to slidably receive the rotation rod 18. Extending from opposed sides 93, 94 of the support body are L-shaped shoulders 96, similar to the shoulder 38 mounted on the carrier bodies 26. The L-shaped shoulders 96 are slidably received in the opposed track raceways 40 in a manner similar to that shown in FIG. 6 for the shoulders 38. The body 90 also includes a projection 98 extending from the bottom of the body. An annular flanged portion 100 is provided adjacent the opening 92 to stabilize the slidable mounting of the body 90 along the rotation rod 18. Use of the elongated L-shaped shoulders 96 and the flanged portion 100 enables the body 90 to be made relatively thin and at the same time stabilize body 90 during traversing. Disposed in the top of the body 90 adjacent side 94 is a slotted opening 102. The opening proper 104 has an inside diameter which is less than the diameter of the cord 22. The opening 102 also includes a tapered portion 106 which facilitates insertion of the cord 22 in the opening proper 104.

Advantageously, the support member 10 is of unitary construction, i.e. it is a one-piece unit with the shoulders, projection, annular flange, and openings formed integrally therewith. The support is advantageously molded out of Nylon or another low-friction plastic material.

Disposed in the central portion of the track is a pin 108 (FIG. 2) which projects upwardly from the bottom of the track adjacent the side thereof next to the end 94 of the support. The projection 98 from the support body 90 and the pin 108 are configured and positioned so that the projection will contact the pin when the support member is traversed along the track 34.

Since the opening proper 104 of the support member 10 has a diameter smaller than that of cord 22, the cord is frictionally engaged in the opening and movement of the cord will traverse the support member when movement of the support member is unimpeded. Movement of the support member will be unimpeded when the support member is between the left end (FIGS. 2 and 3) of the track and the centrally located pin 108. A keeper 110 is secured about the rotation rod 18 adjacent the left end (FIG. 2) of the track and is adapted to contact the annular flange 92 when the support member is in the extreme left hand position. This will limit traversing of the support member at the left end of the rotation rod. As mentioned, the centrally located pin 108 will contact the projection 98 and thereby limit traversing of the support member at the central part of the rotation rod.

Figure 2:
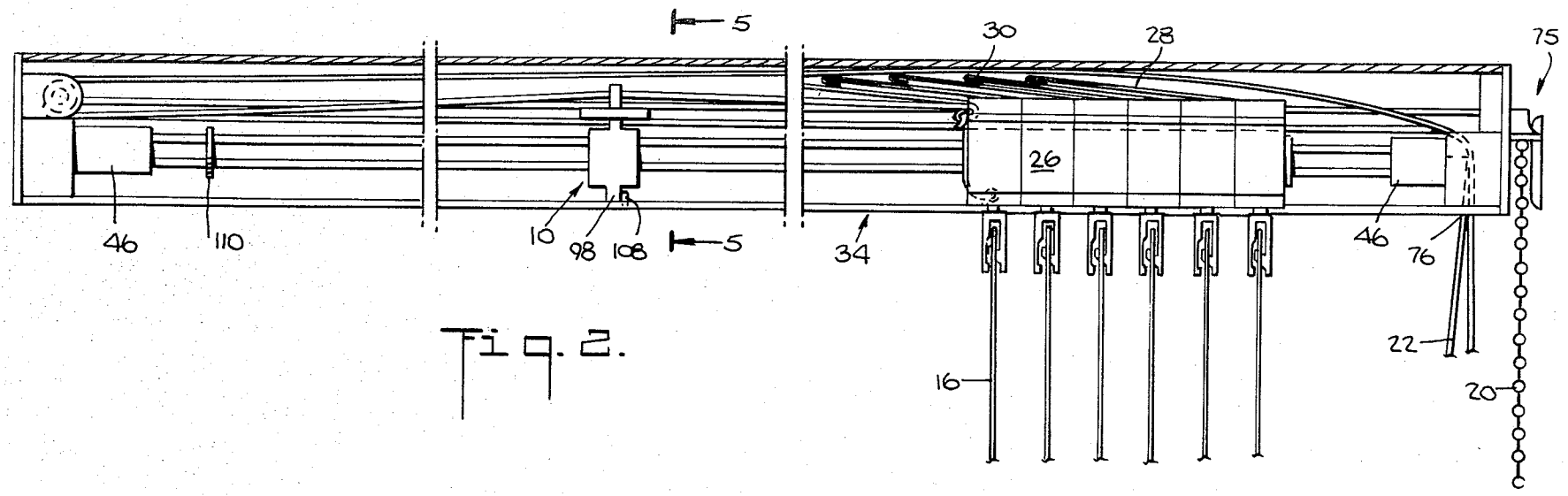
FIG. 2 is a side section view taken longitudinally through the upper track and support structure of the vertical blind structure of FIG. 1 depicting the carrier members supporting the vanes, and the means for traversing the vanes and rotating the vanes, with the carrier members being drawn to the right and stacked and the support member in its rod supporting position in the central region of the track.
Figure 3:
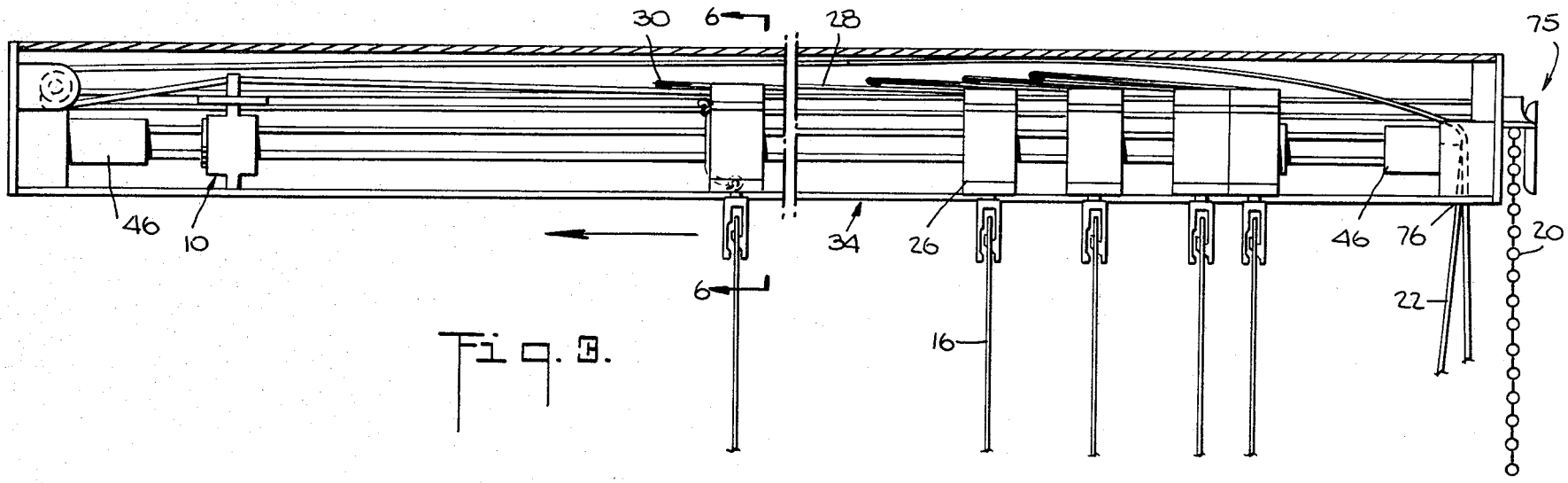
FIG. 3 is a side section view similar to that of FIG. 2 depicting the carrier members and vanes in a partially extended configuration with the support member adjacent the end of the track.

In operation, the support member is engaged by the cord 22 and is traversed between the left (FIGS. 2 and 3) and center portions upon traversing of the carriers as described hereinabove. More particularly, with the support member in the central position as shown in FIG. 2, the carriers are bunched and stacked at the right end of the blind. Since the carrier bodies are located at the extreme right of the blind, except for the support member 10, there is nothing to support the central part of the rotation rod and the cord. The annular flange 100 and opening 92 in the body 90 of the support member engage and support the rod to prevent it from sagging while the hole 104 enagages and supports the cord when the carriers are stacked as shown in FIG. 2. When the cord loop at the side of the blind is pulled to traverse the carriers, the support member is traversed as well and moves to the left (FIGS. 2 and 3) until it contacts the keeper 110. When this occurs, the frictional engagement of the cord in opening proper 104 will be overcome and continued pulling of the cord will traverse the carriers without further traverse of the impeded support member. When the carriers are in a traversed position, the support member 10 is not required since the carriers themselves will act to support the rod and cord. When stacking the carriers, i.e. traversing them to the right as shown in FIG. 3, the support member will again be engaged by the cord and will move to the right with the cord and carriers until the projection 98 contacts the pin 108. The pin will impede further movement of the support member to the right and again the frictional engagement of the cord and hole proper 104 will be overcome by continued pulling of the cord. Continued movement of the cord will traverse the carriers to the right as shown in FIG. 2.

Referring now to FIG. 7, a portion of a support 10A is illustrated which is adapted to roll along a track structure. For this purpose one or more rollers 120 are rotatably connected to each shoulder 96A. Two rollers are preferred to enhance stability and performance. Each roller is connected to the respective shoulder by a pin 122, for example. The rollers are adapted to roll along a suitable track raceway and are made of a low friction material such as Nylon.

In FIG. 8, a portion of another support 10B is illustrated in which a friction means 126 is provided to frictionally engage cord 22. The friction means 126 is a spring finger arrangement comprising three spring fingers 128–130. The spring fingers are springingly attached by pin 132 for example to the support 10B and extend therefrom in a side-by-side disposition. Each finger is adapted to flex transversely to an axis along which the three fingers extend, i.e. transversely to the direction along which the cord extends. The two end fingers 128, 130 are flexed in one direction while the central finger 129 is flexed in the opposite direction and the cord 22 inserted between the end fingers and the central finger. The fingers thereby frictionally engage the cord therebetween.

While the invention has been illustrated and described for a vertical blind having a cord traversing arrangement, it is contemplated that the support in accordance with the invention may be used with other traversing arrangements. For example, where traversing is accomplished by means of a threaded rod as described in the aforementioned U.S. Pat. No. 3,190,346, then the support may be releasably engaged with, for example, the lead carrier body. For example, releasable spring means may interconnect the support and the lead carrier body so that the support moves to the right with the lead carrier body until it strikes a retainer such as pin 108 to release the support from engagement with the lead carrier. When traversing to the left, the lead carrier will move into contact and strike the support to releasably engage the support and carrier so that the support is traversed to the left with the carriers.

It is further contemplated that the invention be utilized with a traversing arrangement in which a wand is secured to a traversable housing in the track structure in which traversing of the housing by the wand traverses the carriers. In such an arrangement, the support may be releasably engaged with the lead carrier as described above.

Additionally, the invention may be embodied and practiced in other traversing devices.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purposes of the disclosure without departing from the spirit and scope of the invention.

What is claimed is:

1. In a vertical blind which includes a plurality of vanes, a plurality of carriers for traversably supporting the vanes, a track structure in which the carriers are traversably mounted, means including a horizontally-extending rod for rotating the vanes and means including a cord for traversing the carriers, the improvement comprising a support for supporting the horizontally-extending rod between predetermined locations in the track structure, the support comprising means for traversably mounting the support in the track structure, an opening in the support through which the horizontally-extending rod extends such that the support in cooperation with the track structure slidably supports the rod between the predetermined locations, means for frictionally engaging the cord such that the support is traversed between the predetermined locations upon movement of the cord, and cooperating means associated with the support and the track structure for limiting movement of the support between the predetermined locations, the engaging means frictionally engaging the cord to traverse the support between the predetermined locations upon movement of the cord to traverse the carriers along a portion of the track structure and releasing the support from engagement with the cord in cooperation with the limiting means at the predetermined locations such that the support remains stationary with respect to the track structure at the predetermined locations upon further movement of the cord.

2. The improvement as recited in claim 1, wherein the support member is of one-piece unitary construction.

3. The improvement as recited in claim 2, wherein the support member is a plastic molded part.

4. The improvement as recited in claim 1, wherein the limiting means comprises a projection connected to the support and a member fixed at one of the predetermined locations of the track structure, the projection being engaged by the fixed member at the one predetermined location, the engaging means being released from engagement with the cord when the projection and fixed member are in contact upon further movement of the cord, whereby the support remains at the one predetermined location upon further movement of the cord and corresponding traversing of the carriers.

5. The improvement as recited in claim 1, wherein the engaging means comprises another opening in the support having a dimension less than that of the thickness of the cord to frictionally engage the cord such that the support moves with the cord between the predetermined locations, the other opening releasing the cord at the predetermined locations where the friction is overcome and the cord slides through the other opening upon further movement of the cord.

6. The improvement as recited in claim 1, wherein the engaging means comprises a spring means which frictionally engages the cord such that the support moves with the cord between the predetermined locations, the spring means releasing the cord at the predetermined locations where the friction is overcome and the cord slides past the spring means upon further movement of the cord.

7. The improvement as recited in claim 1, wherein the spring means comprises a plurality of spring fingers, the cord extending between and being frictionally engaged by the spring fingers.

8. The improvement as recited in claim 1, wherein the support comprises an elongated body extending between opposed tracks of the track structure, the mounting means comprising elongated shoulders extending from opposed sides of the body which are slidably engaged in the opposed tracks.

9. The improvement as recited in claim 1, wherein the support comprises an elongated body extending between opposed tracks of the track structure, the mounting means comprising at least one roller rotatably connected to each side of the body and rotatably received by the respective track.

10. A support for supporting a horizontally-extending rod in a track structure of a vertical blind between predetermined locations in the track structure, the support member comprising means for traversably mounting the support in the track structure, an opening in the support through which the horizontally-extending rod is adapted to extend such that the support in cooperation with the track structure is adapted to slidably support the rod between the predetermined locations, means for frictionally engaging a cord used to traverse carriers in the blind such that the support can be traversed between the predetermined locations upon movement of the cord, means associated with the support adapted to cooperate with means associated with the track structure for limiting traversing of the support between the predetermined locations, the engaging means being adapted to frictionally engage the cord to traverse the support between the predetermined locations upon traversing of the carriers along a portion of the track structure, the engaging means being further adapted to release the support from engagement with the cord in cooperation with the limiting means at the predetermined locations such that the support remains stationary with respect to the track structure at the predetermined locations upon further movement of the cord.

11. The support as recited in claim 10, wherein the support member is of one-piece unitary construction.

12. The support as recited in claim 10, wherein the support member is a plastic molded part.

13. The support as recited in claim 10, wherein the limiting means comprises a projection connected to the support adapted to being engaged by a member fixed at one of the predetermined locations, the engaging means being adapted to being released from engagement with the cord when the projection and fixed member are in contact upon further movement of the cord, whereby the support remains at the one predetermined location upon further movement of the cord and corresponding traversing of the carriers.

14. The support as recited in claim 10, wherein the engaging means comprises another opening in the support having a dimension less than that of the thickness of the cord to frictionally engage the cord such that the support can move with the cord between the predetermined locations, the other opening being adapted to release the cord at the predetermined locations where the friction is overcome and the cord can slide through the other opening upon further movement of the cord.

15. The support as recited in claim 10, wherein the engaging means comprises a spring means which frictionally engages the cord such that the support can move with the cord between the predetermined locations, the spring means being adapted to release the cord at the predetermined locations where the friction is overcome and the cord can slide past the spring means upon further movement of the cord.

16. The support as recited in claim 10, wherein the spring means comprises a plurality of spring fingers adapted to receive and frictionally engage the cord therebetween.

17. The support as recited in claim 10, wherein the support comprises an elongated body adapted to extend between opposed tracks of the track structure, the mounting means comprising elongated shoulders extending from opposed sides of the body which are adapted to being slidably engaged in the opposed tracks.

18. The support as recited in claim 10, wherein the support comprises an elongated body adapted to extend between opposed tracks of the track structure, the mounting means comprising at least one roller rotatably connected to each side of the body and adapted to be rotatably received by the respective track.

* * * * *